United States Patent [19]

Jack

[11] 4,360,276

[45] Nov. 23, 1982

[54] METHOD AND APPARATUS FOR CREATING A PATH THROUGH PARTICULATE MATERIAL

[75] Inventor: James M. Jack, Georgetown, Canada

[73] Assignee: Northern Vibrator Manufacturing Ltd., Georgetown, Canada

[21] Appl. No.: 246,556

[22] Filed: Mar. 23, 1981

[51] Int. Cl.[3] ..... B01F 13/02; B01F 11/00

[52] U.S. Cl. ..... 366/101; 366/108; 366/114; 366/128

[58] Field of Search ..... 366/101, 108, 111, 113, 366/114, 124, 125, 128; 222/196, 198

[56] References Cited

U.S. PATENT DOCUMENTS

| | | | |
|---|---|---|---|
| 2,174,348 | 9/1939 | Damond | 366/108 X |
| 3,079,050 | 2/1963 | Wahl | 366/108 X |
| 3,715,059 | 2/1973 | Hyer | 366/113 |
| 4,062,527 | 12/1977 | Schmitz | 366/128 |
| 4,207,005 | 6/1980 | Stanfield | 366/128 |

*Primary Examiner*—Edward J. McCarthy

*Attorney, Agent, or Firm*—Robert F. Delbridge; Arne I. Fors

[57] ABSTRACT

Apparatus for creating a path through particulate material such as granular or pulverulent material in a storage container is lowerable into the material in the container and includes an upper part attachable to a lowering device and a lower part. The lower part has a downwardly and inwardly inclined outer wall extending to a lower central area, a vibrator for vibrating the outer wall along a substantially vertical axis, and an air nozzle at the lower central area to which air can be supplied.

11 Claims, 6 Drawing Figures

METHOD AND APPARATUS FOR CREATING A PATH THROUGH PARTICULATE MATERIAL

Figure 1:
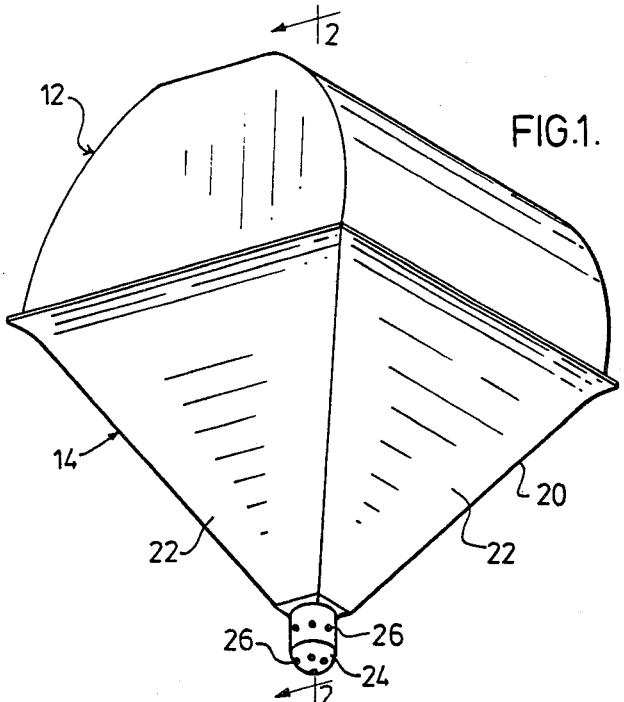

This invention relates to a method and apparatus for creating a path through particulate material such as granular or pulverulent material, in a storage container.

It is common practice to store particulate material in a container, and subsequently remove the material from the container by gravity flow through an opening in the lower part of the container, and it is well known that, depending upon the nature of the material and environmental conditions, the material may form a blockage which prevents material above the blockage from falling downwardly through the opening. Various attempts have been made to provide devices for freeing such blockages, but such prior devices have for one reason or another not been particularly successful in practice.

It is therefore an object of this invention to provide improved means for freeing blockages in particulate material stored in a container.

According to the invention, apparatus for creating a pass through particulate material such as granular or pulverulant material in a storage container is lowerable into the material in the container, and comprises an upper part attachable to a lowering device and a lower part, the lower part having a downwardly and inwardly inclined outer wall extending to a lower central area, vibrator means for vibrating the outer wall along a substantially vertical axis, when the apparatus is suspended from the lowering device, air nozzle means at the lower central area, and means for supplying air to the air nozzle means.

In use of the apparatus in accordance with the invention, the apparatus is lowered into the material in which a blockage has occured, air is supplied through the nozzle means to cause air to be emitted from the nozzle means and displace relatively loose material, and the vibrator means is operated to cause the vertical vibration of the outer wall to displace the material causing the blocking.

Advantageously, the outer wall of the lower part has an inverted pyramidal shape comprising a series of downwardly and inwardly inclined sidewalls of inverted generally triangular shape.

The vibrator means may comprise an air-operated vibrator having an air inlet and air outlet, the apparatus including means for supplying air under pressure to the vibrator inlet. The means for supplying air to the air nozzle means may be connected to the vibrator outlet for receiving air leaving the vibrator and supplying the air to the air nozzle means.

The vibrator means may be carried by the lower part, with the lower part, with the lower part being secured to the upper part by vibration absorbing means. The vibrator means may comprise a housing and a weight rotatably mounted in the housing for eccentric rotation about a substantially horizontal axis, when the apparatus is suspended from the lower device.

The vibrator means may be air-operated and comprise housing means, and a pair of weights independently rotatably mounted in the housing means for eccentric rotation in opposite directions about a substantially horizontal axis, when the apparatus is suspended by the lowering device.

Figure 2:
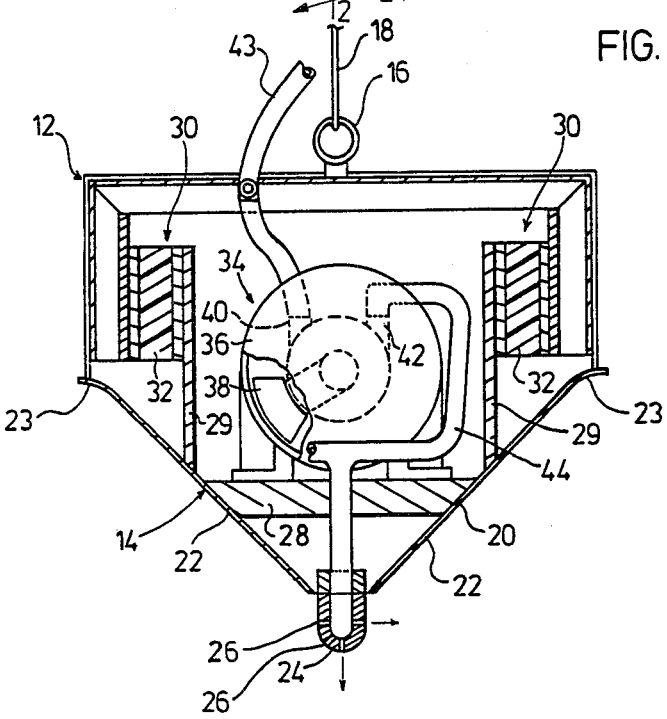
Figure 3:
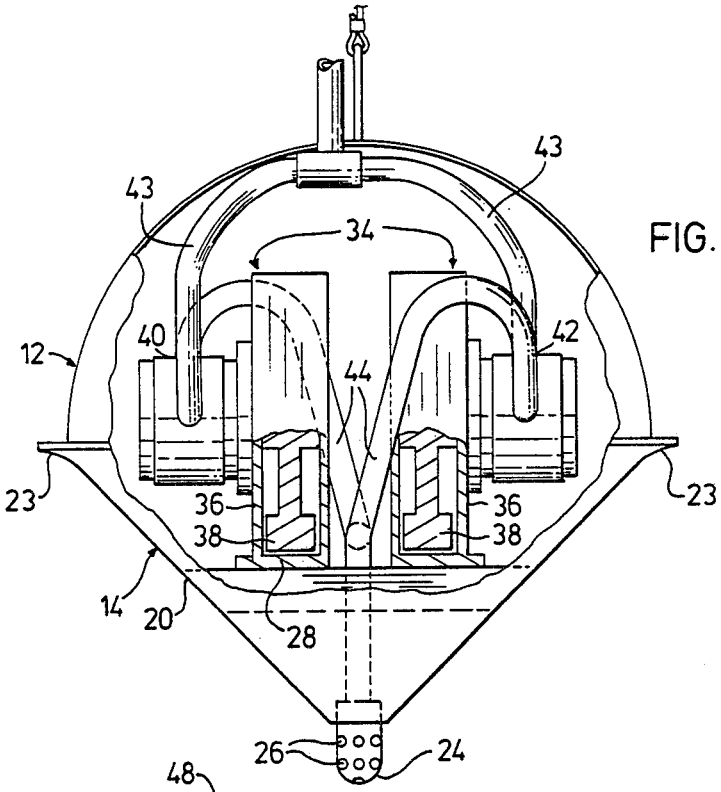
Figure 4:
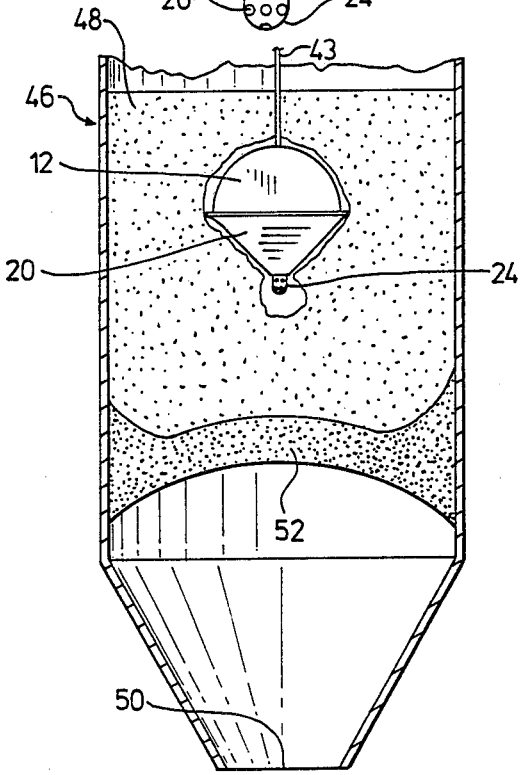
Figure 5:
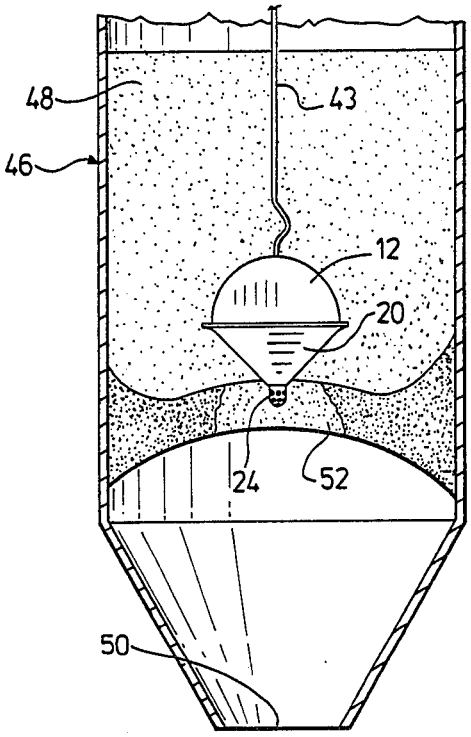
Figure 6:
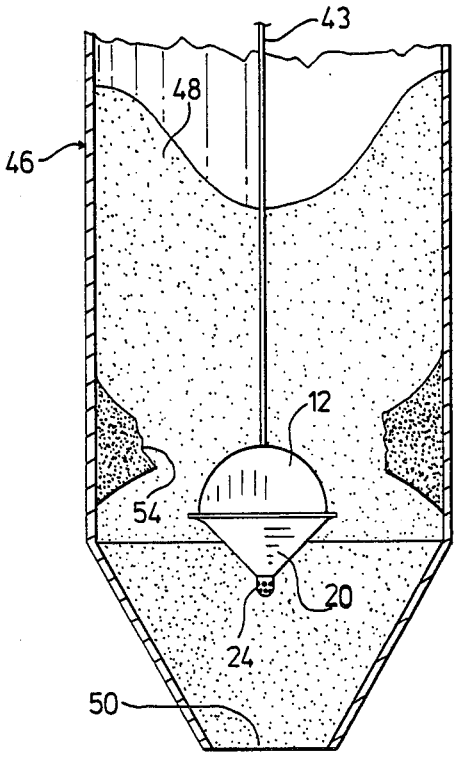

One embodiment of the invention will now be described, by way of example, with reference to the accompanying drawings, of which;

FIG. 1 is a perspective view of apparatus for creating a path through particulate material in a container, FIG. 2 is a sectional side view of the apparatus taken along line 2—2 of FIG. 1, partly in elevation and partly broken away, FIG. 3 is a similar front view of the apparatus, FIG. 4 is a diagramatic front view showing the apparatus being lowered through relatively loose material in a container towards a blockage, FIG. 5 is a similar view showing the apparatus engaging the blockage, and FIG. 6 is a similar view of after the apparatus has created a path through the blockage.

Referring first especially to FIGS. 1 to 3, apparatus for creating a path through particulate material comprises an upper part 12 and a lower part 14. The upper part 12 has a suspension ring 16 to which a lowering device in the form of the cable 18 is secured. The lower part 14 has a downwardly and inwardly inclined outer wall 20 with an inverted pyramidal shape formed by four downwardly and inwardly inclined side walls 22 of inverted generally triangular shape. The side walls 22 extend to a lower central area where an air nozzle 24 with several air outlet passages 26 is located. The upper edges 23 of the side walls 22 curve outwardly as shown beneath the upper part 12.

The side walls 22 are secured to the peripheral edges of a rectangular base plate 28. Just above the base plate 28, hangers 29 extend upwardly to resilient mountings 30 which resiliently connect the lower part 14 to the upper part 12. Each resilient mounting 30 includes a rubber layer 32 which absorbs vibration of the lower part 14, and therefore prevents any substantial transmission of vibrations of the lower part 14 to the upper part 12.

The base plate 28 carries a air of vibrators 34 which each comprises a housing 36 in which a weight 38 is rotatably mounted for eccentric rotation about a horizontal axis. Each vibrator 34 is air-operated and its housing has an air inlet 40 and an air outlet 42. An air hose 43 connected to an air pressure source (not shown) is connected to the inlet 40 of each vibrator 34 so that the supply of air under pressure to the housing 36 thereof causes the weight 38 mounted therein to be rotated. The vibrators 34 are arranged so that the two weights 38 rotate in opposite directions. The vibrators 34 are of known kind, as will be readily apparent to a person skilled in the art.

The air outlets 42 from the vibrator housing 36 are connected to air hoses 44 which supply the air exhausting from the vibrator housing 36 to the air nozzle 24.

Referring now especially to FIGS. 4 to 6, a container 46 contains a particulate material 48 such as soya bean seeds and has a bottom opening 50 through which the material is allowed to flow out of the container 46 when required. The bottom opening 50 will of course be provided with an appropriate closure device in known manner. It may happen that the material 48 may form a blockage in the form of a bridge 52 across the container 46, as shown in FIG. 4, thereby preventing the material 48 above the bridge 52 from moving downwardly to the opening 50.

If such a blockage occurs, apparatus in accordance with the invention is lowered into the material 48 by means of a cable 43, with air under pressure being supplied to the apparatus through the air hose 43, and thereby to the vibrators 34 so as to cause the weight 38 to rotate eccentrically in opposite directions and vibrate the base plate 28 and outer side walls 22 along a vertical axis. At the same time, air exhausted from the vibrators 34 is emitted from the nozzle passages 26 at the lower or leading end of the apparatus.

As shown in FIG. 4, the apparatus passes down through the upper loose material 48 because the jets of air from the nozzle 24 blows the material 48 out of the way, enabling the apparatus to sink downwardly through the material 48. When the apparatus reaches the bridge 52, as shown in FIG. 5, the vertically vibrating outer side walls 22 of pyramidal configuration engage the material 48 forming the bridge 52, and breakup the bridge 52 by means of such vertical vibrations. The inverted pyramidal shape of the outer wall 20 has been found to be very effective for this purpose. The vertical vibrations appear to cause the breakup of a central portion of the bridge 52 from the outer edge portion, so that the central bridge portion falls downwardly to leave an aperture 54.

When the aperture 54 has been formed, the loose material 48 then falls through the aperture 54 to the lower opening 50, as shown in FIG. 6.

The described embodiment is especially useful in connection with particulate material such as soya bean or sunflower seeds, but is also useful with grains and other particulate material.

Other embodiments of the invention will be readily apparent to a person skilled in the art, the scope of the invention being defined in the appended claims.

What we claimed as new and desired to protect by Letters Patent of the United States is:

1. Apparatus for creating a path through particulate material such as granular or pulverulent material in a storage container, said apparatus being lowerable into the material in the container and comprising an upper part attachable to a lowering device and a lower part, the lower part having a downwardly and inwardly inclined outer wall extending to a lower central area, vibrator means for vibrating said outer wall along a substantially vertical axis, when the apparatus is suspended from the lowering device, air nozzle means at the lower central area, and means for supplying air to said air nozzle means.

2. Apparatus according to claim 1 wherein the outer wall of the lower part has an inverted pyramidal shape comprising a series of downwardly and inwardly inclined side walls of inverted generally triangular shape.

3. Apparatus according to claim 1 wherein the vibrator means comprises an air-operated vibrator having an air inlet and an air outlet, the apparatus including means for supplying air under pressure to the vibrator inlet, and the means for supplying air to the air nozzle means being connected to the vibrator outlet for receiving air leaving the vibrator and supplying said air to the air nozzle means.

4. Apparatus according to claim 1 wherein the vibrator means is carried by the lower part, and the lower part is secured to the upper part by vibration absorbing means.

5. Apparatus according to claim 4 wherein the vibrator means comprises a housing and a weight rotatably mounted in the housing for eccentric rotation about a substantially horizontal axis, when the apparatus is suspended from the lowering device.

6. Apparatus according to claim 5 wherein the vibrator is air-operated and the housing has an air inlet and air outlet, the apparatatus including means for supplying air under pressure to the vibrator inlet to cause eccentric rotation of the weight.

7. Apparatus according to claim 4 wherein the vibrator means is air-operated and comprises housing means having air inlet means and air outlet means, and a pair of weights independently rotatably mounted in the housing means for eccentric rotation in the opposite directions about a substantially horizontal axis, when the apparatus is suspended from the lowering device.

8. Apparatus according to claim 2 wherein the vibrator means is air-operated.

9. A method of creating a path through particulate material such as granular or pulverulent material in a storage container, including lowering into the material apparatus comprising a lower part having a downwardly and inwardly inclined outer wall extending to a lower central area, vibrator means for vibrating said outer wall along a substantially vertical axis, and air nozzle means at the lower central area, supplying air to the nozzle means to cause air to be emitted from the nozzle means and displace relatively loose material, and operating the vibrator means to cause vertical vibration of the outer wall to displace material causing blocking.

10. Apparatus according to claim 9 wherein the outer wall of the lower part has an inverted pyramidal shape comprising a series of downwardly and inwardly inclined side walls of inverted generally triangular shape.

11. A method according to claim 10 wherein the vibrator means is air-operated.

* * * * *